US008163073B2

(12) United States Patent
Chan et al.

(10) Patent No.: US 8,163,073 B2
(45) Date of Patent: Apr. 24, 2012

(54) ALKALESCENT CHEMICAL SILVER PLATING SOLUTION

(75) Inventors: Kin Kwok Daniel Chan, Hong Kong (CN); Wing Hong Lai, Hong Kong (CN); Jing Li Fang, Singapore (SG)

(73) Assignee: Chartermate International Limited, Kwai Chung (HK)

( * ) Notice: Subject to any disclaimer, the term of this patent is extended or adjusted under 35 U.S.C. 154(b) by 215 days.

(21) Appl. No.: 12/515,277

(22) PCT Filed: Dec. 8, 2006 (Under 37 CFR 1.47)

(86) PCT No.: PCT/CN2006/003333

§ 371 (c)(1), (2), (4) Date: May 15, 2009

(87) PCT Pub. No.: WO2008/058430

PCT Pub. Date: May 22, 2008

(65) Prior Publication Data

US 2010/0116168 A1 May 13, 2010

(30) Foreign Application Priority Data

Nov. 16, 2006 (HK) ..... 06112617.2

(51) Int. Cl.
*C23C 18/31* (2006.01)

(52) U.S. Cl. ..... 106/1.19; 106/1.23

(58) Field of Classification Search ..... 106/1.19, 106/1.23

See application file for complete search history.

(56) References Cited

U.S. PATENT DOCUMENTS

| | | | | |
|---|---|---|---|---|
| 5,795,828 | A * | 8/1998 | Endo et al. | 106/1.23 |
| 5,955,141 | A * | 9/1999 | Soutar et al. | 427/443.1 |
| 2003/0000846 | A1 * | 1/2003 | Rzeznik et al. | 205/263 |
| 2004/0040852 | A1 * | 3/2004 | Rzeznik et al. | 205/86 |
| 2004/0043159 | A1 * | 3/2004 | Rzeznik et al. | 427/430.1 |

OTHER PUBLICATIONS

WIPO, International Search Authority for International Application No. PCT/CN2006/003333 with English Translation, Aug. 23, 2007.

WIPO, International Preliminary Report on Patentability for International Application No. PCT/CN2006/003333, Mar. 12, 2009.

* cited by examiner

*Primary Examiner* — Helene Klemanski

(74) *Attorney, Agent, or Firm* — Intellectual Property Law Group LLP

(57) ABSTRACT

An alkalescent chemical silver electroless plating solution, which comprises: 0.01~20 g/L silver ion or silver complex ion, 0.1~150 g/L amine complexing agent, 0.1~150 g/L amino acids complexing agent, and 0.1~150 g/L polyhydroxy acids complexing agent. The alkalescent chemical silver plating solution provided by the present invention is able to overcome problems existing in acidic chemical silver plating processes commonly used at present. These problems include gnawing and corrosion of copper wires, lateral corrosion and difficulty of plating silver in blind holes, presence of solder ball voids and low strength of soldering. The silver layer plated by said silver plating solution possesses characteristics of high corrosion resistance, low contact resistance, no electromigration, high welding strength, and avoidance of bubbles produced in the solder when the plating pieces are being welded.

7 Claims, 2 Drawing Sheets

ALKALESCENT CHEMICAL SILVER PLATING SOLUTION

FIELD OF THE INVENTION

The present invention relates to a chemical silver plating solution, and more specifically, to an alkalescent chemical silver plating solution.

BACKGROUND OF THE INVENTION

At present, acidic chemical silver plating solution is commonly used for a silver-plated process in the chemical plating industry; the main problems brought about by using the acidic formula and its corresponding process are:

1. Gnawing and Corrosion of Copper Wires

At present, a nitric acid system is the most popularly system in the world used for the immersion silver. Nitric acid is a strong oxidizer, as well as a strong corrosive. It firstly corrodes parts with high stress in wires, thus causing stress corrosion, with the result that the wires become thin or are gnawed locally. Therefore, the immersion plating time must be strictly limited within 1 minute in a nitrate-based chemical silver plating process. Otherwise, a phenomenon that the wires become thin or become gnawed will appear. However, when the immersion plating time is only 1 minute, there is not enough time for reagents to get to the bottom of a blind hole which results in that the copper is exposed due to the bottom of the blind via not being plated by the silver.

2. Very High Carbon Content in the Silver Plating Layer

For delaying the corrosion of the nitric acid on the copper and promoting the reagents to get into the blind hole, a corrosion inhibitor that easily forms a protective membrane on copper and a penetrant with good permeability must be added into many nitrate-based chemical silver plating solutions. A corrosion inhibitor and penetrant can coprecipitate with silver, thus the silver layer so-called 'organic silver' is formed, that is, the silver layer contains plenty of organics, or the silver layer contains a high content of carbon. The content or purity of the silver of the 'organic silver' layer of these companies is only 70%, that is, the content of carbon is up to about 30%. High carbon content not only influences the conductivity of the silver layer, but also influences the weldability, corrosion resistance of the silver layer and increases high-frequency loss.

3. Void will be Formed in the Solder During Welding, thus Influences the Welding Strength An acidic chemical silver layer contains a large amount of organics or carbon, which can react with the oxygen in the air during high temperature welding to produce carbon monoxide or carbon dioxide which can get into the melted solder. Because of the very high specific gravity of the melted solder, gas is hard to escape after getting into the solder, and finally has been condensed in the solder and then voids are formed. The thicker the silver plating layer is, the higher the total carbon content is, the more or larger the formed voids are, and most of which are centralized at the upside close to the welding pad.

SUMMARY OF THE INVENTION

The primary objective of this invention is to overcome said problems of the prior art and provide a novel alkalescent chemical silver plating solution that is capable of being widely used in the finishing process on the surface of a printed circuit board (PCB).

The alkalescent chemical silver plating solution provided in the present invention comprises components with the following amounts:

| | |
|---|---|
| (1) Silver ion or Silver complex ion | 0.01~20 g/L |
| (2) Amine complexing agent | 0.1~150 g/L |
| (3) Amino acids complexing agent | 0.1~150 g/L |
| (4) Polyhydroxy acids complexing agent | 0.1~150 g/L |

Advantageously, said silver complex ion is at least one selected from silver ammonia complex ion, silver amine complex ion, silver-amino acid complex ion, silver-halide complex ion, silver-sulfite complex ion and silver-thiosulfate complex ion.

Advantageously, said amino acids complexing agent is at least one selected from glycine, α-alanine, β-alanine, cystine, anthranilic acid, aspartic acid, glutamic acid, amidosulphonic acid, imido disulfonic acid, aminodiacetic acid, nitrilotriacetic acid (NTA), ethylenediamine tetraacetic acid (EDTA), diethylenetriaminepentaacetic acid (DTPA), hydroxyethylethylenediaminetriacetic acid (HEDTA) or aromatic amino acid (e.g. Pyridine-dicarboxylic acid).

Advantageously, said amino acids complexing agent is at least one selected from glycine, α-alanine, β-alanine, cystine, anthranilic acid, aspartic acid, glutamic acid, amidosulphonic acid, imido disulfonic acid, aminodiacetic Acid, nitrilotriacetic acid (NTA), ethylenediamine tetraacetic acid (EDTA), diethylenetriaminepentaacetic acid (DTPA), hydroxyethylethylenediaminetriacetic acid (HEDTA) or aromatic amino acid (e.g. Pyridine-dicarboxylic acid).

Advantageously, said polyhydroxy acids complexing agent comprises at least one selected from citric acid, tartaric acid, gluconic acid, malic acid, lactic acid, 1-hydroxy-ethylidene-1, 1-diphosphonic acid, sulfosalicylic acid, phthalic acid or their alkali metal salts or ammonium salts.

Advantageously, the amount of said silver ion or silver complex ion is 1~80 g/L.

Advantageously, the amount of said amine complexing agent is 1~80 g/L.

Advantageously, the amount of said amino acids complexing agent is 1~80 g/L.

Advantageously, the amount of said polyhydroxy acids complexing agent is 1~80 g/L.

Advantageously, the pH value of the chemical silver plating solution is 8~10, the plating temperature is 40~70° C.

By employing the alkalescent chemical silver plating solution provided in the present invention, the following advantages are obtained:

a) The nitric acid free plating solution will not induce the problems of gnawing and corroding the copper wires and lateral corrosion.

b) The plating solution is completely a complexing agent system that does not contain corrosion inhibitor and penetrant. The silver layer obtained is a pure silver layer, which has excellent conductivity, anti-blushing ability and very low high frequency loss. Moreover, the layer is easy to wash and has a low contact resistance and high wire bond strength.

c) There is no void in the solder ball during the welding for the pure silver layer, and the welding strength is high.

d) The plating solution is alkalescent with a pH value of 8~10, thus will not corrode the solder mask. The plating time can be set to 1~5 minutes to ensure all of the inside of a blind via is plated with silver without gnawing and corroding the copper wire and without lateral corrosion.

DETAILED DESCRIPTION OF SPECIFIC EMBODIMENTS

Embodiment 1

Figure 1A:
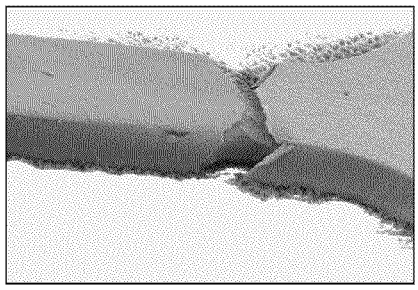
FIG. 1*a* is a schematic diagram showing the copper wire being gnawed off after being immersed in a nitrate-based silver plating solution for 3 minutes.

An alkalescent chemical silver plating solution according to a first embodiment is described with the components and amounts as follows:

| | |
|---|---|
| Silver nitrate | 0.6 g/L |
| Triethylenetetramine | 20 g/L |
| Glycine | 10 g/L |
| Citric acid | 5 g/L |
| Deionized water | remainder |

In the chemical plating process, the pH value is adjusted to 7.8~8.2 by ammonia water. It merely needs about 5 minutes to plate the workpiece at a temperature of about 70° C. by using this silver plating solution.

Embodiment 2

An alkalescent chemical silver plating solution accordingly to a second embodiment is described with the components and amounts as follows:

| | |
|---|---|
| $Ag^+$ ($[Ag(NH_3)_2]^+$) | 2 g/L |
| EDTA | 30 g/L |
| Ammonium nitrate | 40 g/L |
| Lactic acid | 2 g/L |
| Deionized water | remainder |

In the chemical plating process, the pH value is adjusted to 8.2~8.8 by ammonia water. It merely needs about 1 minute to plate the workpiece at a temperature of about 50° C. by using this silver plating solution.

Embodiment 3

An alkalescent chemical silver plating solution according to a third embodiment is described with the components and amounts as follows:

| | |
|---|---|
| Silver nitrate | 6 g/L |
| DTPA | 40 g/L |

-continued

| | |
|---|---|
| Ammonium citrate tribasic | 30 g/L |
| Deionized water | remainder |

In the chemical plating process, the pH value is adjusted to 8.8~9.2 by ammonia water. It merely needs about 0.5 minute to plate the workpiece at a temperature of about 45° C. by using this silver plating solution.

Embodiment 4

An alkalescent chemical silver plating solution according to a fourth embodiment is described with the components and amounts as follows:

| | |
|---|---|
| Silver nitrate | 10 g/L |
| Ammonium carbonate | 40 g/L |
| Sulfosalicylic acid | 40 g/L |
| Lactamine | 40 g/L |
| Deionized water | remainder |

In the chemical plating process, the pH value is adjusted to 7.8~8.2 by ammonia water. It merely needs about 3 minutes to plate the workpiece at a temperature of about 40° C. by using this silver plating solution.

Embodiment 5

An alkalescent chemical silver plating solution according to a fifth embodiment is described with the components and amounts as follows:

| | |
|---|---|
| Silver sulfate | 3 g/L |
| Ammonium sulfate | 20 g/L |
| Imido disulfonic acid | 30 g/L |
| Ammonium citrate | 2 g/L |
| Deionized water | remainder |

In the chemical plating process, the pH value is adjusted to 8.8~9.2 by ammonia water. It merely needs about 2 minutes to plate the workpiece at a temperature of about 55° C. by using this silver plating solution.

Embodiment 6

An alkalescent chemical silver plating solution according to a sixth embodiment is described with the components and amounts as follows:

| | |
|---|---|
| Silver nitrate | 1 g/L |
| Ammonium phosphate | 20 g/L |
| Lactamine | 60 g/L |
| Phthalandione | 10 g/L |
| Deionized water | remainder |

In the chemical plating process, the pH value is adjusted to 9.8~10.2 by ammonia water. It merely needs about 3 minutes to plate the workpiece at a temperature of about 50° C. by using this silver plating solution.

Embodiment 7

An alkalescent chemical silver plating solution according to a seventh embodiment is described with the components and amounts as follows:

| | |
|---|---|
| Silver amidosulphonic acid | 8 g/L |
| Amidosulphonic acid | 30 g/L |
| Ammonium sulfate | 50 g/L |
| Tartaric acid | 20 g/L |
| Deionized water | remainder |

In the chemical plating process, the pH value is adjusted to 9.2~9.8 by ammonia water. It merely needs about 0.5 minute to plate the workpiece at a temperature of about 60° C. by using this silver plating solution.

Embodiment 8

An alkalescent chemical silver plating solution according to an eighth embodiment is described with the components and amounts as follows:

| | |
|---|---|
| Silver nitrate | 0.8 g/L |
| Picolinic acid | 20 g/L |
| Ammonium sulphonate | 80 g/L |
| Gluconic acid | 2 g/L |
| Deionized water | remainder |

In the chemical plating process, the pH value is adjusted to 9.2~9.8 by ammonia water. It merely needs about 5 minutes to plate the workpiece at a temperature of about 60° C. by using this silver plating solution.

Embodiment 9

An alkalescent chemical silver plating solution according to a ninth embodiment is described with the components and amounts as follows:

| | |
|---|---|
| Silver nitrate | 3 g/L |
| Ethylenediamine | 10 g/L |
| Sulfonicsalicyl acid | 40 g/L |
| Amidodiacetic acid | 5 g/L |
| Deionized water | remainder |

In the chemical plating process, the pH value is adjusted to 8.2~8.8 by ammonia water. It merely needs about 3 minutes to plate the workpiece at a temperature of about 50° C. by using this silver plating solution.

Embodiment 10

An alkalescent chemical silver plating solution according to a tenth embodiment is described with the components and amounts as follows:

| | |
|---|---|
| Silver amidosulphonic acid | 4 g/L |
| Ammonium Nitrate | 35 g/L |
| Ethanolamine | 20 g/L |
| Malic acid | 10 g/L |
| Deionized water | remainder |

In the chemical plating process, the pH value is adjusted to 9.8~10.2 by ammonia water. It merely needs about 1.5 minutes to plate the workpiece at a temperature of about 60° C. by using this silver plating solution.

The alkalescent chemical silver plating solution provided by this invention is capable of overcoming drawbacks existing in acidic chemical silver plating processes commonly used at present worldwide. These drawbacks include gnawing and corrosion of copper wires, lateral corrosion, difficulty of plating silver in a blind hole, solder ball voids and low strength of the welding.

Comparative Cases:

1) Merchandise of MacDermid Inc., U.S. Pat. No. 6,200,451(2001)

| | |
|---|---|
| Sterling ™ Silver A (75097) | 5% |
| Sterling ™ Silver B (75098) | 10% |
| Nitric acid | 3% |
| Pure water | 83% |
| Temperature | 43-54° C. |

Merchandise of MacDermid Inc., U.S. Pat. No. 6,200,451 (2001)

| | |
|---|---|
| Hydroxyethylenediamine tetracetic acid (HEDTA) | 10 g/L |
| Silver nitrate | 2.4 g/L |
| igepal Co730 (surfactant) | 5.0 g/L |
| Imidazole | 10 g/L |
| Nitric acid | 32 ml/L |

2) Enthone Inc. WO2006022835

| | |
|---|---|
| Silver nitrate | 1 g/l |
| HEDTA | 10 g/l |
| Benzimidazole | 1 g/L |
| EO/PO copolymer (surfactant) | 1 g/l |
| Nitric acid | 0.98 g/L |
| pH | 2 |

The main problems which easily appeared in the above comparative cases are:

1. Gnawing and Corrosion of Copper Lines

Figure 1B:
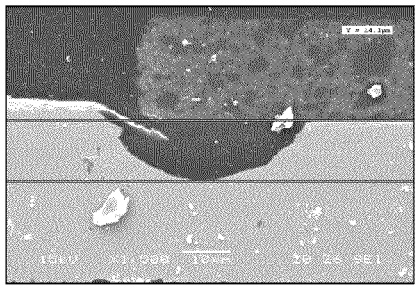
FIG. 1*b* is a schematic diagram showing the copper wire being laterally corroded after being immersed in a nitrate-based silver plating solution for 3 minutes.

Wires usually become thin or partly gnawed. Therefore, the time of immersion must be strictly limited within 1 minute in using a concentrated nitrate-based immersion silver process. Otherwise, the condition of wires becoming thin or being gnawed will appear. FIGS. 1*a* and 1*b* respectively show the conditions of the copper wire being gnawed and laterally corroded after being immersed in a nitrate-based silver plating solution for 3 minutes. However, when the time of immersion is only 1 minute, there is not enough time for reagents to get to the bottom of a blind hole which results in copper exposure due to the bottom of the blind via not being plated by the silver.

2. Very High Carbon Content in the Silver Plating Layer

Figure 2:
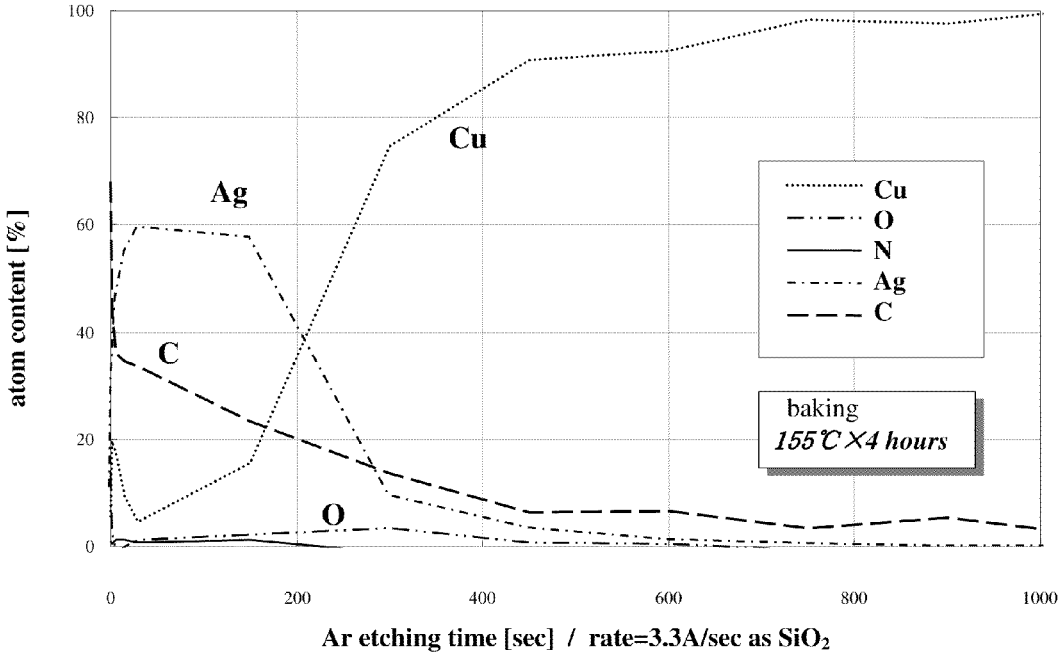
FIG. 2 is a pattern showing the XPS depth denudation of the acidic chemical silver plating layer.

The silver layer obtained in the comparative cases are usually called "organic silver", that is, the silver layer contains many organics, or the silver layer contains a large amount (10-30%) of carbon. High carbon content not only influences the conductivity of the silver layer, but also influences the weldability, corrosion resistance of the silver layer and increases high-frequency loss. FIG. 2 is a pattern showing the XPS depth denudation of the acidic chemical silver plating layer.

Figure 3:
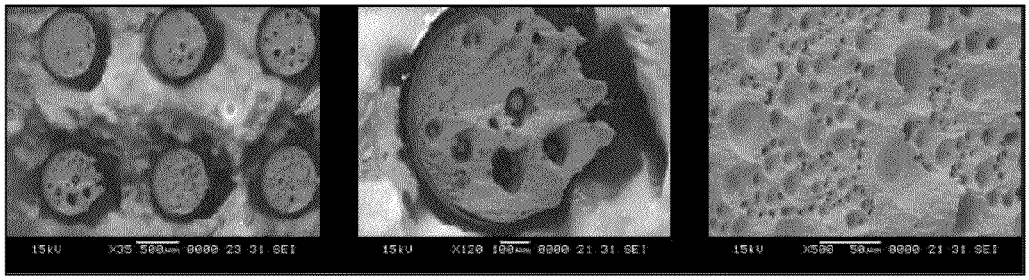
FIG. 3 is a SEM micrograph of the void formed by the acidic chemical silver plating layer when welding.

3. Void will be Formed in the Solder During Welding, thus Influences the Welding Strength The large amount of organics or carbon in the silver layer can react with the oxygen in the air during high temperature welding to produce carbon monoxide or carbon dioxide which can get into the melted solder, become condensed in the solder and form voids. The thicker the silver plating layer is, the higher total carbon content is, the more or larger the formed voids are, and most of which are centralized at the upside close to the welding pad. FIG. 3 is a SEM micrograph showing the void formed by the acidic chemical silver plating layer when welding.

Figure 4:
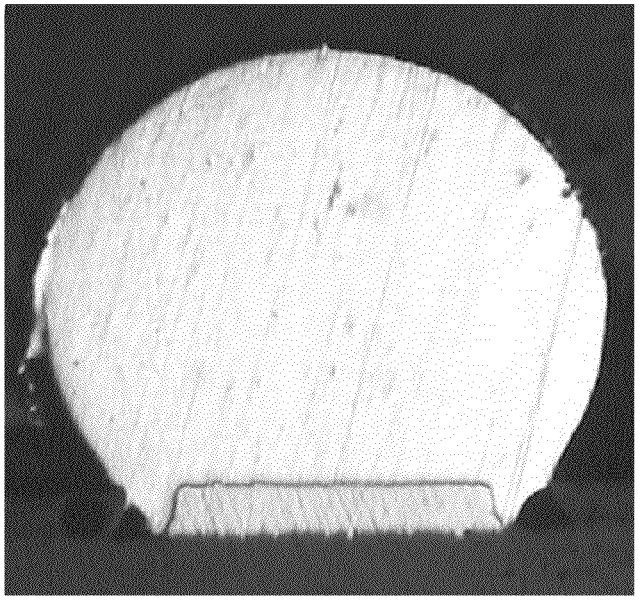
FIG. 4 is a slice image of the chemical silver plating layer obtained by an alkalescent chemical silver plating solution provided by an embodiment of this invention after the welding.

Compared to the above comparative cases, using an alkalescent chemical silver plating solution provided by an embodiment of the present invention results in overcoming problems existing in acidic chemical silver plating processes commonly used at present. These problems include gnawing and corrosion of copper wires, lateral corrosion, difficulty of plating silver in a blind hole, solder ball voids and low strength of the welding. As shown in FIG. 4, there is a slice image of the chemical silver plating layer obtained by an alkalescent chemical silver plating solution provided by an embodiment of the present invention after the welding.

We claim:

1. An alkalescent chemical silver plating solution, comprising components with following amounts:

| | |
|---|---|
| (1) Silver ion or Silver complex ion | 0.01~50 g/L |
| (2) Amine complexing agent | 0.1~80 g/L |
| (3) Amino acids complexing agent | 0.1~80 g/L |
| (4) Polyhydroxy acids complexing agent | 0.1~80 g/L, |

wherein the amine complexing agent comprises at least one selected from the group consisting of ammonia, ammonium citrate tribasic, ammonium phosphate, ammonium sulfate, ammonium nitrate, ammonium acetate, and ammonium carbonate; and wherein a pH value of the chemical silver plating solution is adjusted by ammonia water.

2. The alkalescent chemical silver plating solution according to claim 1, wherein, said silver complex ion is at least one selected from the group consisting of silver ammonia complex ion, silver amine complex ion, silver-amino acid complex ion, silver-halide complex ion, silver-sulfite complex ion and silver-thiosulfate complex ion.

3. The alkalescent chemical silver plating solution according to claim 1, wherein, said amine complexing agent further comprises at least one selected from the group consisting of methylamine, ethylamine, ethylenediamine, 1,2-propylenediamine, 1,3-propylenediamine, diethylene triamine, triethylenetetramine, triamine triethylamine, imidazole, aminopyridine, aniline, and phenylenediamine.

4. The alkalescent chemical silver plating solution according to claim 1, wherein, said amino acids complexing agent is at least one selected from the group consisting of glycine, α-alanine, β-alanine, cystine, anthranilic acid, aspartic acid, glutamic acid, amidosulphonic acid, imido disulfonic acid, aminodiacetic acid, nitrilotriacetic acid, ethylenediamine tetraacetic acid, diethylenetriaminepentaacetic acid, hydroxyethylethylenediaminetriacetic acid and aromatic amino acid.

5. The alkalescent chemical silver plating solution according to claim 1, wherein, said polyhydroxy acids complexing agent is at least one selected from the group consisting of citric acid, tartaric acid, gluconic acid, malic acid, lactic acid, 1-hydroxy-ethylidene-1,1-diphosphonic acid, sulfosalicylic acid, phthalic acid and their alkali metal salts and ammonium salts.

6. The alkalescent chemical silver plating solution according to claim 1, wherein, the amount of said silver ion or silver complex ion is 0.01~20 g/L.

7. The alkalescent chemical silver plating solution according to claim 1, wherein, the pH value of the chemical silver plating solution is 8~10, the plating temperature is 40~70° C.

* * * * *